US006094176A

United States Patent [19]

Van Hoozen et al.

[11] Patent Number: 6,094,176

[45] Date of Patent: Jul. 25, 2000

[54] VERY COMPACT AND BROADBAND PLANAR LOG-PERIODIC DIPOLE ARRAY ANTENNA

[75] Inventors: Allen Lee Van Hoozen, Schaumburg; John Joseph Ball, McHenry, both of Ill.

[73] Assignee: Northrop Grumman Corporation, Los Angeles, Calif.

[21] Appl. No.: 09/198,853

[22] Filed: Nov. 24, 1998

[51] Int. Cl.[7] ..... H01Q 11/10

[52] U.S. Cl. ..... 343/792.5

[58] Field of Search ..... 343/792.5; H01Q 11/10

[56] References Cited

U.S. PATENT DOCUMENTS

| | | | |
|---|---|---|---|
| H680 | 9/1989 | Alfing et al. | 343/785 |
| 3,106,714 | 10/1963 | Minerva | 343/792.5 |
| 3,732,572 | 5/1973 | Kuo | 343/792.5 |
| 3,765,022 | 10/1973 | Tanner | 343/792.5 |
| 4,205,317 | 5/1980 | Young | 343/720 |
| 4,296,416 | 10/1981 | Harader | 343/792.5 |
| 4,494,121 | 1/1985 | Walter et al. | 343/708 |
| 4,673,948 | 6/1987 | Kuo | 343/792.5 |
| 4,754,287 | 6/1988 | Shelton et al. | 343/792.5 |
| 4,814,783 | 3/1989 | Shelton et al. | 343/795 |
| 4,987,424 | 1/1991 | Tamura et al. | 343/795 |
| 5,057,850 | 10/1991 | Kuo | 343/792.5 |
| 5,093,670 | 3/1992 | Braathen | 343/792.5 |
| 5,111,211 | 5/1992 | Dahlberg | 343/700 |
| 5,184,141 | 2/1993 | Connolly et al. | 343/705 |
| 5,214,432 | 5/1993 | Kasevich et al. | 342/3 |
| 5,223,849 | 6/1993 | Kasevich et al. | 343/895 |
| 5,541,613 | 7/1996 | Lam et al. | 343/792.5 |

FOREIGN PATENT DOCUMENTS

| | | | |
|---|---|---|---|
| 1336481 | 9/1962 | France | 343/795 |
| 1359037 | 6/1963 | France | 343/795 |

OTHER PUBLICATIONS

The Microwave Journal; *Size–Reduced Log–Periodic Dipole Array Antenna*—Technical Feature; Sam C. Kuo, GTE Sylvania Electronic Systems Group, Western Div., Mountain View, CA., Dec. 1972; pp. 27, 28 31–33.

*Primary Examiner*—Michael C. Wimer
*Attorney, Agent, or Firm*—Terry J. Anderson; Karl J. Hoch, Jr.

[57] ABSTRACT

A compact broadband log-periodic antenna for transmitting and receiving frequencies between 0.5 to 18 GHZ. The antenna comprises two dielectric substrates bonded together, both substrates comprise a first group of dipole elements configured in a log-periodic sequence and a second group of serpentine configured dipole elements fabricated on the same substrate and in electrical communication with the first group of elements. The serpentine dipole elements are configured in a specific pattern such that the size of the antenna is reduced, yet still maintains log-periodic characteristics. Disposed between the two substrates is a feed system in electrical communication with both groups of elements such that a connector from a transmitter or receiver can be in communication with the antenna.

14 Claims, 2 Drawing Sheets

VERY COMPACT AND BROADBAND PLANAR LOG-PERIODIC DIPOLE ARRAY ANTENNA

FIELD OF THE INVENTION

The present invention generally relates to log-periodic dipole antennas, and more particularly to a compact log-periodic antenna fabricated on a planar array for an operating frequency bandwidth of 0.5–18 GHz.

BACKGROUND OF THE INVENTION

There is currently known in the prior art various configurations for log-periodic dipole antennas. Such log-periodic antennas use logarithmic-periodic, electrically conducting elements to receive and transmit communication signals. Log-periodic antennas are described in antenna design handbooks, such as, *Antenna Theory Analysis and Design* by Constantine Balanis; *Antennas*, 2nd Edition, by John D. Kraus; and the IEEE *Handbook of Antenna Design, Volumes* 1 and 2. Log-periodic antennas use a combination of dipole antenna elements configured in a manner whereby the dimensions and spacings between the elements are logarithmically related to the frequency range over which the antenna is to operate. The above-mentioned handbooks set forth formulas which may be used to determine the specific dimensions and spacing parameters for traditional log-periodic antennas. As such, U.S. Pat. No. 5,093,670, *Logarithmic Periodic Antenna* (incorporated by reference herein), additionally includes general information on the design of log-periodic antennas.

As will be recognized by those familiar with antenna design, the size of the antenna is based upon the operating frequencies for transmitting and receiving signals. Usually, the length of the longest antenna element is proportional to the lowest frequency to be received or transmitted, and accordingly the length of the shortest element is proportional to the highest frequency to be received or transmitted. Therefore, the length of the antenna elements for a high frequency antenna will be shorter than the length of the antenna elements for a lower frequency antenna. In this respect, in order to have a very broadband antenna array, there will be a great discrepancy between the length of the shortest and longest elements.

In the prior art, the dipole antenna elements have been triangles, rectangles, rods, meandering lines or 3-dimensional "blocks/lumps" in an effort to make the antenna as compact as possible, yet still retain broadband frequency capabilities. For example, U.S. Pat. No. 3,732,572—*Log Periodic Antenna With Foreshortened Dipoles* (incorporated by reference herein), describes shortening longer dipole elements into rectangular tubes or blocks in order to shorten the longer dipole antenna elements. This reduces the overall size of the antenna, yet still maintains the broadband characteristics therein. In *Foreshortened Dipole Antenna With Triangular Radiators*, U.S. Pat. No. 4,673,948, the antenna comprises both rectangular shaped dipole elements and triangular shaped elements in order to also shorten the elements and the overall size of the antenna.

Additionally in the prior art, it is customary to arrange the log-periodic antenna elements in pairs on alternating sides of a center conductor. The center conductor may consist of two conducting strips, or feeders, that run down the middle of the alternating pairs of antenna elements. One feeder may connect to one side of the pair of elements while the second feeder connects to the other element of the pair. The feeder may additionally connect to alternating elements of the pairs, for example, it will connect to the "left" element of one pair and then the "right" element of the next pair and so on.

It is also known to fabricate log-periodic dipole antennas using printed circuit technology. As such, the elements of the antenna are implanted in or on a surface of an insulating substrate. The antenna elements are formed on the same plane of a substrate such that the principle beam axis for each frequency of the antenna is in the same direction. The substrate supports the elements and keeps them in the desired configuration so as to make the elements impervious to climatic conditions because of the rigidity and longevity of the dielectric substrate. Furthermore, antennas fabricated from printed circuit technology are light-weight and rugged thus making the antennas portable and suitable for many different types of applications.

Prior art antenna arrays for operating frequencies between 0.5–18 GHz have not been manufactured in a compact design that is easy to fabricate or rugged enough to withstand the vibration for aircraft applications. Typically, prior art designs for the above mentioned frequency range have been fabricated on printed wiring boards (PWB) that were large in cross-sectional shape but had minimal thickness (i.e., 9"×18" but only 0.02" thick). These antenna arrays could survive the harsh operating environment of an aircraft because of the etched design of the printed wiring board; however, their cross-sectional size made them impracticable for compact applications.

On the other hand, log-periodic antennas with block lump arrays are fabricated with 3-D elements that are small in cross sectional area, but are usually thick (i.e., thickness is about 0.5"). Additionally, block lump arrays are not an etched PWB but are constructed by soldering the antenna elements to parallel coaxial cables. Therefore, these antennas have significant shortcomings surviving the shock, vibration and other mechanical requirements of many applications because of the soldering of antenna elements. Furthermore, the soldering of individual pieces produces an antenna that is costlier than one etched on a printed wiring board. Therefore, there is presently a need for a very compact broadband antenna array for 0.5–18 GHz bandwidth that is fabricated by etching a PWB.

The present invention addresses the above-described deficiencies in the prior art by providing an antenna array that is very compact and operates over a wide range of frequencies. The present invention uses a log-periodic design and foreshortens the longer radiating elements in a specific manner in order to maintain the log-periodic characteristics of the antenna, yet still provide a compact form. Specifically, the invention increases the frequency range, particularly the lower frequency limit, without increasing the overall dimensions of the antenna size. Additionally, the present invention is fabricated on a PWB that provides the necessary strength to survive the vibration and mechanical requirements of many applications.

SUMMARY OF THE INVENTION

In accordance with the preferred embodiment of the present invention, there is provided a compact broadband log-periodic antenna for operating frequencies between 0.5 to 18 GHz comprising a first generally planar insulating substrate having an inner side and an outer side and a second generally planar insulating substrate having an inner side and an outer side wherein the inner side of the second insulating substrate is in laminar juxtaposition with the inner side of the first insulating substrate. Additionally, a feedline for communicating with a transmitter/receiver is bonded between the inner side of the first substrate and the inner side of the second substrate. The antenna constructed in accordance with the preferred embodiment also includes a first log-periodic antenna array formed on the outer side of the first substrate. The first log-periodic antenna array includes a plurality of log-periodic antenna elements in electrical communication with a common electrically grounded center conductor and the feedline. Each of the antenna elements has an axial length and at least one of the antenna elements is formed in a serpentine configuration to shorten its axial length. The antenna also includes a second log-periodic antenna array formed on the outer side of the second substrate. The second array also includes a plurality of log-periodic elements in communication with only a common electrically grounded center conductor. Furthermore, at least one of the antenna elements is formed in a serpentine configuration to also shorten its axial length. Both the first and second antenna arrays may be formed in mirror image relation to each other.

In accordance with the preferred embodiment of the present invention, both the first and second substrates have a generally rectangular configuration and are both bonded together such that the common center conductor of both the first and second arrays are disposed in generally parallel longitudinal relation to each other.

Additionally, both the first and second substrates may be printed wiring boards and be bonded together with an adhesive. The first and second substrates may each comprise a generally square configuration of 6 by 6 inches with a combined thickness of 0.01 inches.

Both the first and second log-periodic antenna arrays can comprise nineteen rectangular dipole elements and three serpentine elements. The rectangular dipole elements are arranged whereby the ratio of the length between two adjacent dipole elements is 1.216, the ratio of the spacing between adjacent dipole elements is 1.216 and the ratio of the strip width between adjacent elements is 1.216. The serpentine elements all have a strip width equal to about 0.64 inches, and a first serpentine element has a height of about 0.6 inches, and angle between segments of 29 degrees and comprises 10 serpentine segments. A second serpentine element has a height of about 0.4 inches, an angle between segments of 43 degrees and comprises 9 segments. Finally, a third serpentine element comprises 8 segments with an angle of about 82 degrees between adjacent segments and a total height of about 0.2 inches.

BRIEF DESCRIPTION OF THE DRAWINGS

These as well as other features of the present invention, will become more apparent upon reference to the drawings wherein.

DETAILED DESCRIPTION OF THE PREFERRED EMBODIMENT

Figure 1:
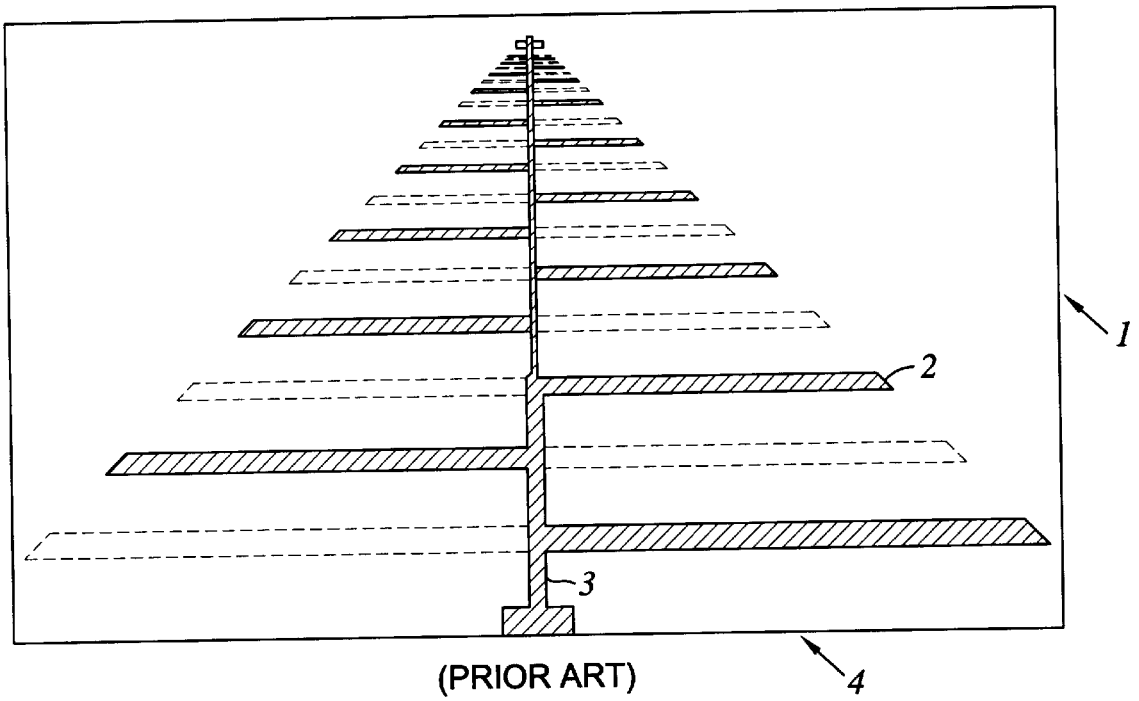
(PRIOR ART) Fig. 1
FIG. 1 is a plan view of a prior art log-periodic antenna.

Referring now to the drawings wherein the showings are for purposes of illustrating a preferred embodiment of the present invention only, and not for purposes of limiting the same, FIG. 1 is a plan view of the prior art log-periodic antenna 1 as already mentioned above.

Specifically, the prior art antenna comprises a first array of dipole elements 2 radiating from a center conductor 3 formed on an outer side of a substrate 4. The first array of dipole elements 2 are formed on one side of the substrate 4. Additionally, as seen by the dotted lines, the dipole elements 2 are formed on the other side of the substrate 4 in mirror image relation. However, the prior art log-periodic antenna 1 does not foreshorten the dipole elements 2 in any manner in an effort to reduce the overall size of the antenna 1.

Figure 2:
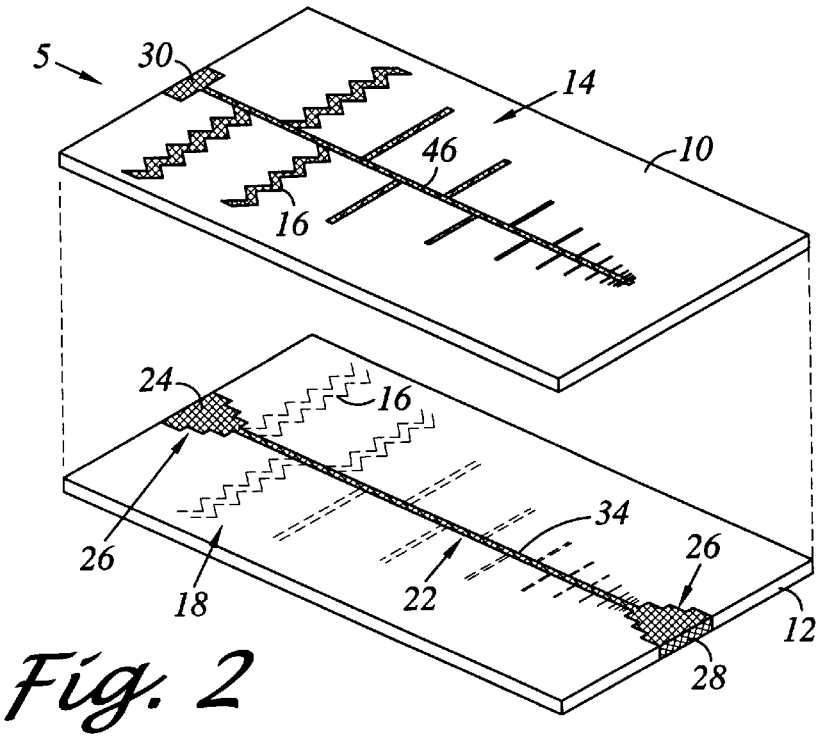
FIG. 2 is an exploded perspective view of an antenna constructed in accordance with the preferred embodiment of the present invention and showing the substrate layers used to construct the antenna.

A compact log-periodic antenna 5 constructed according to the preferred embodiment of the present invention is shown in FIG. 2 and is fabricated upon a first generally planar substrate 10 and a second generally planar substrate 12 of a dielectric material bonded together. Both the first substrate 10 and the second substrate 12 typically have a length of about 6 inches and a width of about 6 inches with a thickness of roughly about 0.01 inches. Therefore, when the layers are bonded with a film adhesive to form antenna 5, the antenna occupies a volume of only about 6 inches by 6 inches by 0.02 inches. The substrates can be a printed wiring board (PWB) or any other type of dielectric material; however, a PWB is ideally suited for this type of application because the antenna array can be etched onto the PWB with a copper material thereby producing an array that can survive the shock and vibration present in many applications. Additionally, an antenna 5 manufactured in this manner is cost effective because the antenna elements do not need to be soldered together, thereby avoiding additional labor in the construction of the antenna.

As can be seen in FIG. 2, an antenna 5 constructed in accordance with the preferred embodiment of the present invention consists of a first log-periodic antenna array 14 etched onto an outer side of the first substrate 10. The first log-periodic antenna array 14 consists of dipole elements 16 configured in a specific manner to maintain the antenna's broadband characteristics while reducing the size as will be further explained in greater detail below. The dipole elements 16 can be etched copper or any other type of material commonly used in printed wiring board applications. The antenna 5 of the preferred embodiment also consists of the second substrate 12 with a second log-periodic antenna array 18 etched on an outer side also. The second log-periodic array 18 on the second substrate 12 is identical to the first array 14 on the first substrate 10; however, when first substrate 10 is bonded to second substrate 12 with first and second arrays 14 and 18 in an outward relation to each other as shown in FIG. 2, then the first array 14 is in mirror image relation to the second array 18 when viewed straight through both substrates.

As previously discussed, first substrate 10 and second substrate 12 are bonded together in order to form a planar antenna 5 constructed in accordance with the preferred embodiment of the present invention. Disposed between the inner sides of the first substrate 10 and the second substrate 12 is a feedline 22. The feedline 22 is fabricated from a metal conductor such as copper and extends in a perpendicular relationship to the dipole elements 16 such that dipole elements 16 radiate in an outwardly direction and in the same plane as feedline 22. The feedline 22 has a connector end 24 adapted to accept the center conductor of a connector (not shown) from a transmitter and/or receiver.

Additionally, feedline 22 contains transformer sections 26 that match the impedance of the connector with the impedance of the antenna 5 through standard stripline impedance matching techniques. The transformer sections 26 provide a "step-up/step-down" arrangement to allow a thin inner line conductor 34 of feedline 22 to traverse the interior of the printed wiring boards such that the body of each log-periodic design forms a ground plane.

In order for proper operation of the antenna 5, the feedline 22 wraps around the second substrate 12 at short circuit end 28 and connects to the second antenna array 18 on the etched side of the second substrate 12. Ground connections to the antenna 20 are additionally furnished to antenna 5 at ground connector location 30 on the etched side of first substrate 10 and also at an identical ground connector location (not shown) on the etched side of the second substrate 12.

Figure 3:
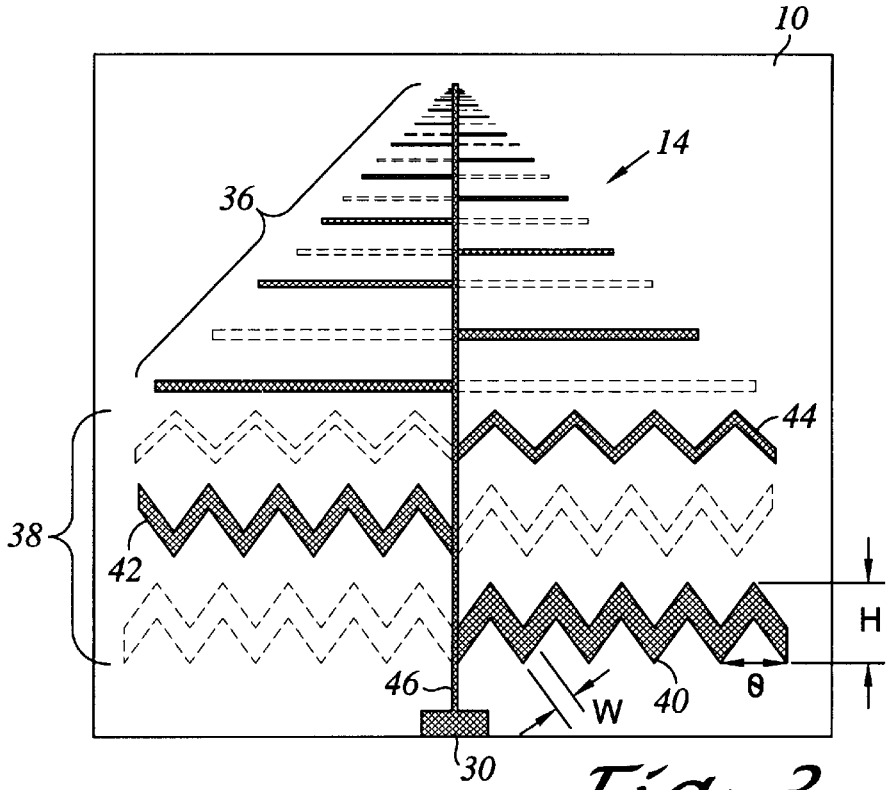
FIG. 3 is a plan view of an antenna constructed in accordance with the preferred embodiment of the present invention.

In accordance with the preferred embodiment of the present invention, dipole elements 16 are configured in a specific manner in order to reduce the overall size of antenna 5 but still maintain broadband frequency characteristics. FIG. 3 is a plan view showing first substrate 10 with the first antenna array 14 bonded to the second substrate 12 with the second array 18 shown by dotted lines. Therefore when viewed through first substrate 10, antenna arrays 18 and 14 are mirror images of one another.

In discussing the pattern of dipole elements 16, reference will be made to the first antenna array 14, however, it is understood that the second antenna array 18 may be identical to the first array 14. As can be seen in FIG. 3, the antenna array 14 comprises two groups of dipole elements; a first group 36 made up of generally rectangular dipole elements and a second group 38 made up of generally serpentine dipole elements.

In accordance with the preferred embodiment of the present invention, the first group of elements 36 are fabricated on the outer side of the first substrate 10 and are generally rectangular in shape and formed on the plane of substrate 10. The spacing and dimensions for the first group 36 follow standard log-periodic design equations for length, width and spacing. For example, the ratio of the length of elements between two adjacent rectangular elements is 1.216, as well as the ratio of the spacing between two adjacent elements is 1.216, and additionally the ratio of the strip width between two adjacent elements is 1.216. Typically, the dimensions for the first rectangular element are dependent upon the highest frequency/lowest wavelength of signal wished to be transmitted and/or received. From this information, it is possible to derive the dimensions for the rest of the rectangular elements by following the standard log-periodic equations that are currently known in the art. However, in order to transmit or receive lower frequency/longer wavelength signals, the dipole elements become long and cannot fit within a compact rectangular space of only 6 inches by 6 inches as envisioned in the present invention. Therefore, it is necessary to foreshorten the longer elements in some manner and yet still maintain a log-periodic relationship for proper operation of the antenna. The antenna 5 constructed in accordance with the preferred embodiment of the present invention shortens the serpentine configured dipole elements 40, 42, and 44 in a specific manner determined using computer simulations involving TOUCHSTONE, PCAAD and AWAS software products and confirmed via test measurements. Accordingly, exact dimensions were found for elements 40, 42 and 44 which shorten the elements to a size that will fit within a space of 6 inches by 6 inches; however, will still maintain the log-periodic characteristics and broadband frequency capabilities of the antenna.

Accordingly, as seen in FIG. 3, each serpentine configured element of the second group 38 has a strip line width W of about 0.064 inches. A first serpentine configured element 40 is made up of 10 serpentine segments that have an angle θ of about 29 degrees between adjacent segments and a total height H of about 0.6 inches. A second serpentine configured element 42 is similarly constructed with 9 serpentine segments with an angle θ of about 43 degrees between adjacent segments and a total height H of about 0.4 inches. While a third serpentine configured element 44 is similarly constructed with 8 serpentine segments, an angle θ of about 82 degrees and a total height H of about 0.6 inches. Therefore, an antenna 5 constructed in accordance with these dimensions will have broadband characteristics for frequencies between 0.5 GHz–18 GHz.

Both the first group and second group of dipole antenna elements 36 and 38 are connected to a common electrically grounded center conductor 46 in a standard log-periodic manner whereby adjacent dipole elements 16 alternately radiate outwardly from opposite sides of center conductor 46 as shown in FIG. 3. The center conductor 46 can be etched from a copper material like the antenna array 14 and is usually about 0.05 inches wide. Additionally for proper operation, the center conductor 46 has a ground connection location 30 on the first substrate 10 for the connection of a ground wire from a transmitter and/or receiver. As previously mentioned, second substrate 12 also has a ground connection point at a location corresponding to the ground connecter location 30 of the first substrate 10. Additionally, as best seen in FIG. 2, feedline 22 wraps around second substrate 12 at short circuit end 28 to connect with the end of the center conductor 46 at a location opposite the ground connection. Therefore, following standard log-periodic antenna techniques, the second antenna array 18 is connected to ground directly and to the center conductor from a transmitter/receiver through feedline 22, while the first antenna array is only in direct communication with the ground connector.

Figure 4:
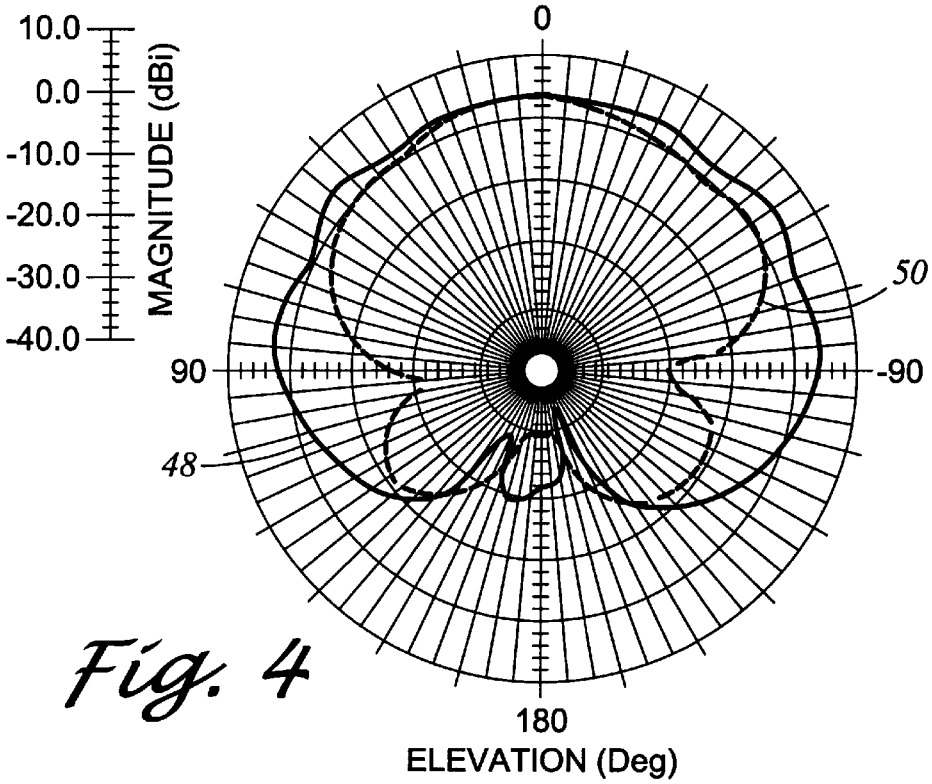
FIG. 4 shows the typical gain patterns for the antenna constructed in accordance with the preferred embodiment of the present invention.

In the preferred embodiment of the present invention, the ideal configuration of dipole elements for an antenna that has an operating range between 0.5–18 GHz consists of 11 dipole elements on each side of the center conductor as shown by FIG. 3. Therefore there are 22 dipole elements fabricated on each substrate and 3 of them will need to be foreshortened in a serpentine manner as previously described in order to fit within a 6 inch by 6 inch space. As such, the antenna 5 constructed in this manner will be linearly polarized and can be used for receiving and/or transmitting functions while still being independent of the receiver and/or transmitter attached to it. Typical gain patterns in the E/H plane are shown in FIG. 4. Pattern 48 is for an antenna with azimuth=0.0, polarization=0.0 and frequency=1.75 Ghz, while pattern 50 is for azimuth=90.00, polarization=90.00 and frequency=1.75 Ghz.

Additional modifications and improvements of the present invention may also be apparent to those of ordinary skill in the art such as different dimensions for the serpentine elements, or shortening the rectangular dipole elements in a manner whereby the size of the system can be further reduced. Thus, the particular combination of parts described and illustrated herein is intended to represent only a certain embodiment of the present invention, and is not intended to serve as a limitation of alternative devices within the spirit and scope of the invention.

What is claimed is:

1. A compact broadband log-periodic antenna comprising:

a) a first generally planar insulating substrate having an inner side and an outer side;

b) a second generally planar insulating substrate having an inner side and an outer side wherein said inner side of said second insulating substrate is in laminar juxtaposition with said inner side of said first insulating substrate;

c) an electrically conductive feedline bonded between the inner side of said first substrate and the inner side of said second substrate, said feedline in electrical communication with a transmitter/receiver;

d) a first log-periodic antenna array formed on the outer side of said first substrate, the antenna array including:
a plurality of log-periodic antenna elements each with an axial length wherein at least one of said antenna elements is formed in a serpentine configuration to shorten said axial length of the element; and
a common electrically grounded center conductor in electrical communication with the plurality of log-periodic antenna elements and in electrical communication with said feedline; and e) a second log-periodic antenna array formed on the outer side of said second substrate, the antenna array including:
a plurality of log-periodic antenna elements each with an axial length wherein at least one of said antenna elements is formed in a serpentine configuration to shorten said axial length of the element; and
a common electrically grounded center conductor in electrical communication with the plurality of log-periodic antenna elements.

2. The antenna of claim 1 wherein said first log-periodic antenna array is formed onto said outer side of said first substrate in mirror image relation to said second log-periodic antenna array formed onto said outer side of said second substrate.

3. The antenna of claim 1 wherein the feedline is a generally planar thin metallic conductor with a connector for the transmitter/receiver.

4. The antenna of claim 1 wherein said first substrate and said second substrate each have a generally rectangular configuration and are both bonded together such that the common center conductor of said first log-periodic antenna array and the common center conductor of said second log-periodic antenna array are disposed in generally parallel longitudinal relation to each other.

5. The antenna of claim 1 wherein said first substrate and said second substrate are each printed wiring boards and are bonded together with an adhesive.

6. The antenna of claim 1 wherein the antenna has an impedance and the feedline is constructed to match the impedance of the antenna with an impedance of a transmitter/receiver connector.

7. The antenna of claim 1 wherein said first substrate and said second substrate each comprise a generally square configuration of 6 by 6 inches, and a combined thickness of about 0.02 inches.

8. The antenna of claim 1 wherein both said first and second log-periodic antenna arrays are each fabricated from copper.

9. The antenna of claim 1 wherein both said first and second log-periodic antenna arrays each comprise nineteen generally rectangular dipole elements each having a strip width, a length and a spacing distance between adjacent elements and three serpentine configured dipole elements, each with a height of a serpentine element, a number of serpentine segments, and an angle between adjacent serpentine segments.

10. The antenna of claim 9 wherein for each said first and second log-periodic antenna arrays, the ratio of the length between adjacent generally rectangular dipole elements is about 1.216, the ratio of the spacing between adjacent generally rectangular dipole elements is about 1.216, and the ratio between the width of adjacent generally rectangular dipole elements is about 1.216.

11. The antenna of claim 10 wherein for each of said first and second log-periodic antenna arrays, the serpentine configured elements are disposed on alternating sides of said common center conductor.

12. The antenna of claim 11 wherein for each said first and second log-periodic antenna array, each serpentine element has a strip width of the dipole element equal to about 0.64 inches.

13. The antenna of claim 12 wherein for each said first and second log-periodic antenna array, a first serpentine dipole element has a height of about 0.6 inches, an angle of about 29 degrees and 10 segments, a second serpentine element has a height of about 0.4 inches, an angle of about 43 degrees and 9 segments, and a third serpentine dipole element has a height of about 0.2 inches, an angle of about 82 degrees and 8 segments.

14. The antenna of claim 1 wherein the antenna operates in a frequency range between about 0.5 GHz to about 18 GHz.

* * * * *